United States Patent [19]

Goyarts

[11] 3,967,744

[45] July 6, 1976

[54] EXTENSIBLE REACH LOAD LIFTING MECHANISM

[75] Inventor: Wynand M. J. M. Goyarts, Battle Creek, Mich.

[73] Assignee: Clark Equipment Company, Buchanan, Mich.

[22] Filed: Feb. 18, 1975

[21] Appl. No.: 550,894

[52] U.S. Cl. ..... 214/770; 212/55; 214/141; 214/146.5

[51] Int. Cl.[2] ..... E02F 3/74

[58] Field of Search ..... 214/134, 139, 140, 141, 214/148, 771, 770, 776, 75 G, 75 H, 660, 146.5; 212/73, 74, 75, 55, 56

[56] References Cited

UNITED STATES PATENTS

| | | | |
|---|---|---|---|
| 3,198,359 | 8/1965 | Lull | 214/776 |
| 3,230,717 | 1/1966 | Alden | 214/771 |
| 3,302,809 | 2/1967 | Eaves | 214/660 |
| 3,593,867 | 7/1971 | Moe | 214/148 |
| 3,791,543 | 2/1974 | Peltonen | 214/660 |

FOREIGN PATENTS OR APPLICATIONS

| | | | |
|---|---|---|---|
| 1,092,381 | 11/1960 | Germany | 214/660 |
| 2,115,502 | 10/1971 | Germany | 214/140 |

*Primary Examiner*—Robert J. Spar
*Assistant Examiner*—Ross Weaver
*Attorney, Agent, or Firm*—John C. Wiessler

[57] ABSTRACT

An extensible reach load lifting mechanism for a truck or similar vehicle in which a first boom assembly is mounted pivotably from the rear portion of the vehicle and extends lengthwise thereof having a hydraulic cylinder actuator for raising and lowering the boom about the pivot connection, the boom also forming a trackway. A trolley assembly is mounted in the trackway of the boom and a drive mechanism actuates selectively the trolley longitudinally of the boom, a second boom assembly which extends lengthwise of the first boom being pivotably mounted from the trolley for raising and lowering movement about the trolley pivot by a second hydraulic cylinder actuator, and for actuation lengthwise of the first boom on the trolley assembly at any position of elevation of the first boom. A load handling device is supported from the outer end of the second boom and is tiltable in relation thereto, slave cylinder means being suitably connected between the vehicle and the first boom and between the first and second booms for actuating a load tilt cylinder during elevation of either one or both of the first and second booms for maintaining the load handling device in a selected attitude.

19 Claims, 10 Drawing Figures

EXTENSIBLE REACH LOAD LIFTING MECHANISM

BACKGROUND OF THE INVENTION

This application covers an improvement of my co-pending application Ser. No. 474,390, filed May 30, 1974.

A truck or other vehicle having an extensible reach mechanism is particularly useful and advantageous in the construction field, in that loads can be picked up, delivered to the construction or building site, and lifted to and placed upon scaffolding, without the necessity for special or separate handling to transfer the load from the vehicle to the scaffold platform or other work supporting structure. This type of vehicle has the further special advantage of being able to pick up a load immediately in front of the vehicle where the ground is firm, transport the load to the work site, and deliver it to an elevated scaffold platform or partially completed building and yet avoid driving onto the usually soft backfill around and outside of the building.

Various conventional constructions of extensible reach vehicles are known including a parallelogram arrangement for the members which support the forwardly extending boom, with the members pivotally connected to one another and to the vehicle frame, and a reach type loader vehicle in which a pivoted boom and load handling device is pivoted about its one end from a trolley which is actuatable longitudinally along a fixed track mounted from the vehicle. In my above co-pending application I have disclosed an improvement over such prior art in which a unique reach linkage has the capability both of relatively long forward thrust and high vertical lift without sacrificing substantially the forward thrust at the elevated positions.

A principal object of the present invention is to provide an extensible reach linkage for a lift truck or similar vehicle which has the capability of combining substantially longer forward thrust of a load handling device at a plurality of vertical lift positions with a substantially higher maximum vertical lift position for a given range of vehicle sizes without sacrificing substantially the forward thrust at any given elevated position, and which permits the vehicle to be maneuvered readily while carrying a load.

Another object is to provide an extensible reach truck in which the load supporting device will operate to maintain the load at a predetermined attitude relative to the ground both during elevation and reach operations, and which provides maximum versatility of any selected combination of elevation and forward thrust from a negative lift position below ground level to both a higher elevation and longer forward thrust than has been heretofore possible.

Another object is to provide an extremely compact, rugged, and relatively simple extended reach mechanism of the aforesaid type which has relatively good stability in all load handling positions, and which can be adapted to various types of vehicle designs without extensive modifications of the basic structure of the mechanism.

SUMMARY

An extensible reach load lifting mechanism for a truck or similar vehicle in which a first boom assembly is mounted pivotably from one end of the vehicle and provides a longitudinal trackway which extends lengthwise of and above the vehicle, a second boom assembly which extends lengthwise of and above the first boom is mounted pivotably from a trolley device mounted for longitudinal actuation in the trackway of the first boom, and a load handling device is mounted from the opposite end of the second boom assembly, all said assemblies and devices being variously actuatable selectively to effect relatively extremely high lift and long forward thrust of the load handling device, while providing a vehicle and reach mechanism which has good stability in various load handling positions and in which the load handling device can be maintained in a predetermined attitude during elevation and forward thrust thereof.

DESCRIPTION OF THE PREFERRED EMBODIMENT

Figure 1:
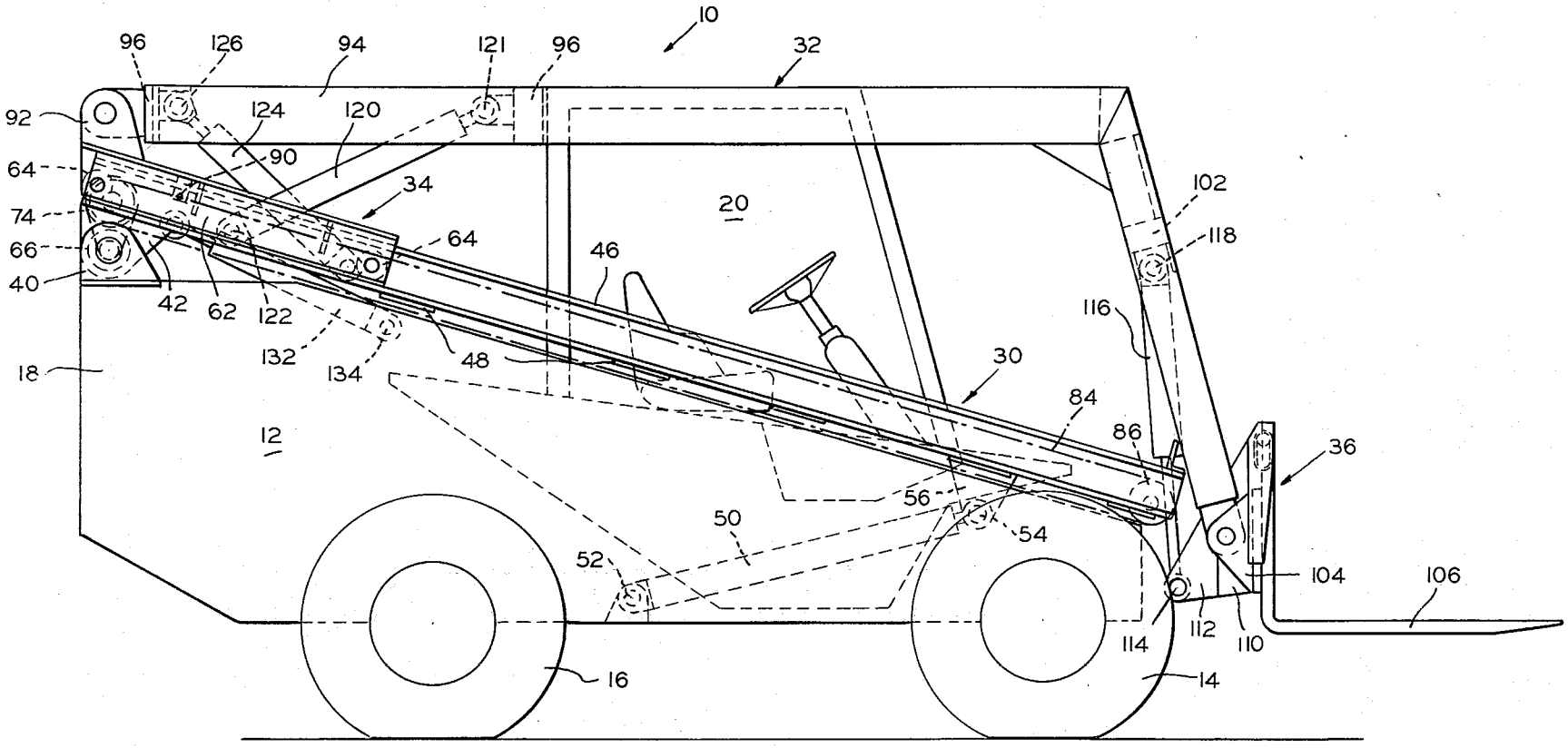
FIG. 1 is a side elevational view of a truck having the present extensible reach load lifting mechanism mounted thereon.
Figure 2:
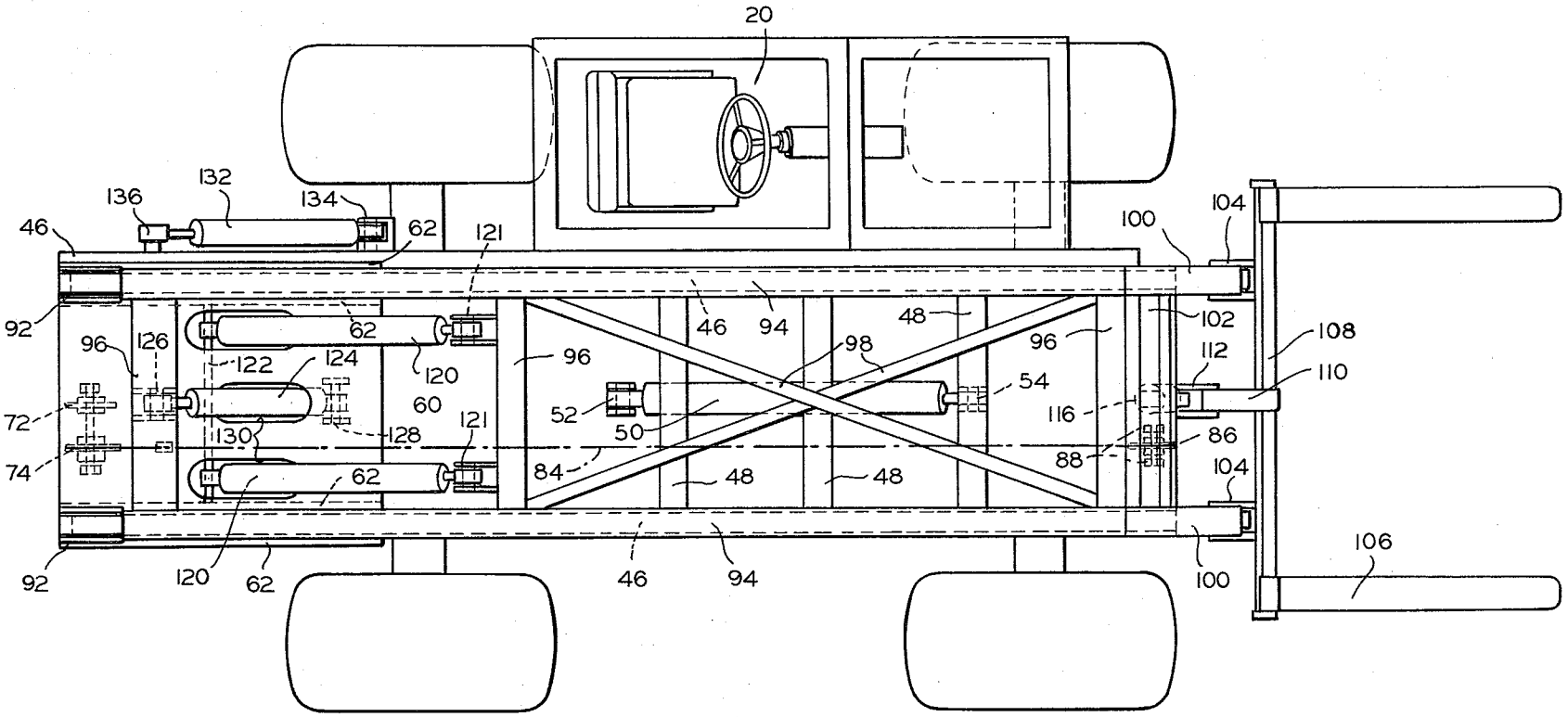
FIG. 2 is a plan view of the truck and load lifting mechanism shown in FIG. 1.
Figure 3:
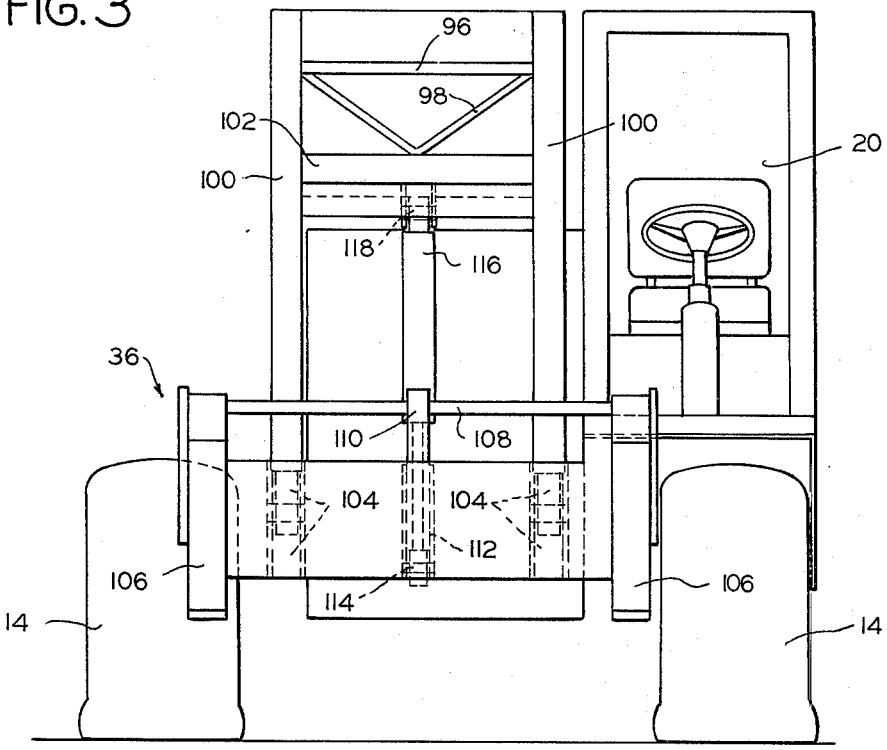
FIG. 3 is a front elevational view of the truck and load lifting mechanism.

A truck suitable for mounting the present extensible reach device 10 is shown generally at 12 of any suitable type having, for example, front drive wheels 14 and rear steerable wheels 16, a prime mover for driving the truck and providing power for operating the extensible reach device, it being under a hood or cover 18 and being connected by a suitable drive train to wheels 14, the operator's control station being shown at 20. While the extensible reach mechanism may be mounted on various types of trucks and vehicles, the one shown has two longitudinal side frame members and a plurality of cross members forming the support for the motor, drive train, controls and cab, and also forming the base support for the extensible reach mechanism.

In general, the extensible reach load lifting mechanism includes (see FIG. 9 for best clarity) a first boom assembly 30 mounted pivotably from opposite rear side portions of the truck body, a second boom assembly 32 mounted pivotably from opposite rear side portions of a trolley assembly 34 which is roller mounted in tracks of the longitudinal beams of boom 30 and selectively actuatable lengthwise thereof, a pivotably mounted selectively tiltable load handling device 36 mounted from the forward end of boom assembly 32, and a plurality of hydraulic actuator and slave cylinders which are adapted to selectively and independently elevate boom 30 relative to the truck, elevate boom 32 relative to the truck and to boom 30, and tilt or slave a predetermined attitude of load handling device 36 relative to the ground at any combination of positions of booms 30 and 32, all at any selected longitudinal position of trolley 34 on boom 30, all such functions being selectively and independently controlled by the operator.

Referring now most particularly to FIGS. 1–3, 9 and 10, the lower boom assembly 30 is mounted pivotably to the rear portion of the truck body and counterweight section 12 and on opposite sides thereof by a pair of generally U-shaped brackets 40 registering with pin and bracket connections 42 which depend downwardly from a transverse plate member 44 to which are secured, as by welding, a pair of transversely spaced longitudinally extending I-beams 46 extending longitudinally of the truck at opposite sides thereof and having suitable transverse bracing longitudinally spaced and connecting the bottom surfaces of the I-beams as at 48. A longitudinally extending hydraulic cylinder assembly 50 is mounted centrally of the truck, the base end thereof being pivotally connected to a frame member at 52 and the rod end thereof being pivotally connected at 54 to a bracket 56 which depends from one of transverse members 48.

Trolley assembly 34 includes a flat plate member 60 which extends transversely of and above the upper flanges of the I-beams and which is roller mounted to travel longitudinally of the I-beams by a means of downwardly extending longitudinal plates 62 which form with plate 60 a pair of elongated inverted U-shaped mounting units interiorly of which are suitably mounted pairs of rollers 64 engaging the respective opposed tracks of each I-beam such that the trolley assembly may be freely actuated longitudinally of the I-beam.

It has been found convenient to utilize in my invention a drive chain and sprocket drive means for selectively actuating trolley 34 along boom assembly 30. As illustrated somewhat schematically, a hydraulic drive motor 66 is mounted from the one side of a downwardly depending plate 68 secured to plate 44 at the one side of a U-shaped notch 70 in which is mounted a pair of drive sprockets 72 and 74 keyed to a shaft 76 mounted from a pair of bearing blocks 78, sprocket 72 being driven by a chain 80 reeved on a drive wheel 82 driven by motor 66. An endless trolley drive chain 84 straddles plate 44 and braces 48 and is reeved at its opposite end to a sprocket 86 which may be suitably mounted in bearing blocks 88 secured to the top side of the forwardmost transverse brace 48. The drive chain 84 is connected suitably to the trolley by means of a chain connector 90 which is secured to the underside of trolley plate 60. Thus, actuation of motor 66 drives chains 80 and 84 by means of sprockets 82, 72 and 74 to selectively actuate the trolley to any selected position longitudinal of boom assembly 30.

Upper boom assembly 32 is mounted from the rear end pivotally to upwardly projecting, transversely spaced bifurcated brackets 92 which are secured to opposite rear corner portions of plate 60 of the trolley. The boom comprises a pair of transversely spaced, longitudinally extending beams 94 having transverse and diagonal braces 96 and 98 connecting the beams and downwardly and forwardly extending beam portions 100 extending from the forward ends of beams 94, suitably braced transversely by a member 102 and by the load carrier assembly 36 which is pivotably mounted from the lower ends of beams 100 by a pair of transversely spaced bifurcated pin and bracket connectors 104. The load carrier assembly, as illustrated, includes a pair of fork tines 106 supported pivotally from a transverse shaft 108 which is connected by a downwardly extending and centrally located support member 110 and a bifurcated bracket 112 secured thereto pivotally to the rod end 114 of a hydraulic tilt cylinder assembly 116, pivotally supported from its base end 118 by a pin and bracket connected to brace member 102.

Figure 9:
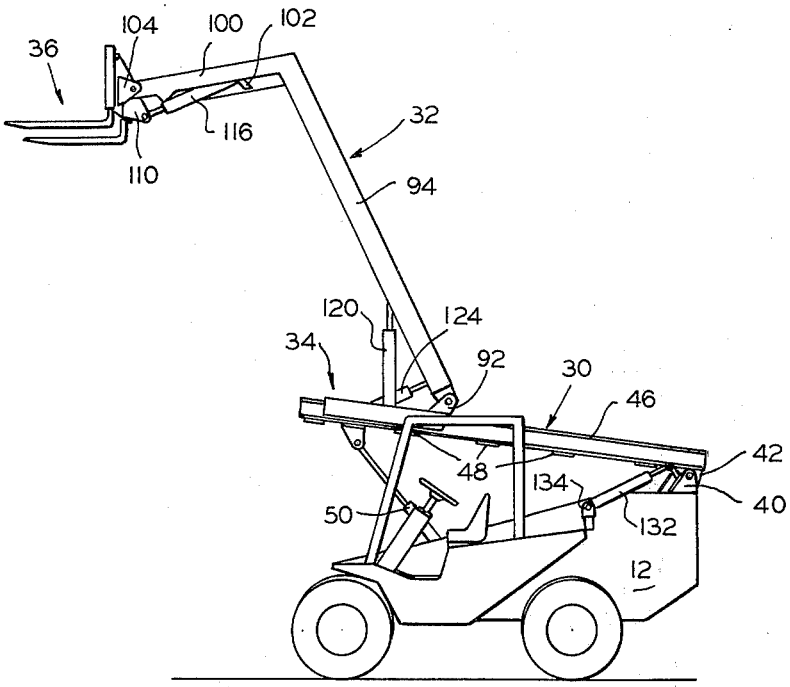
Figure 10:
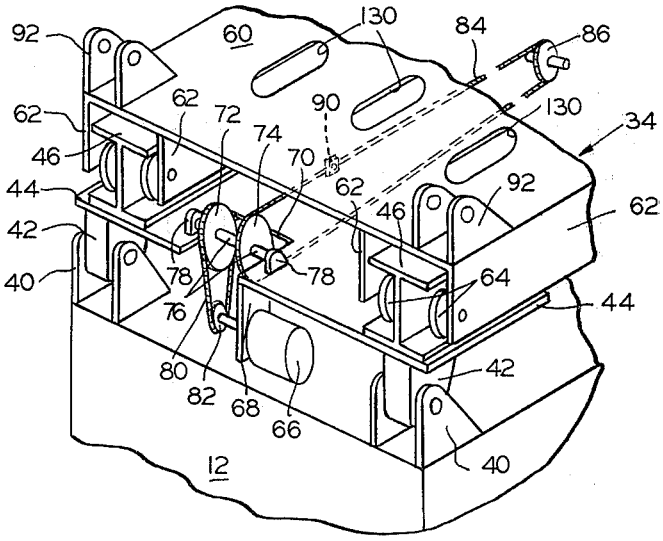
FIG. 10 is a broken-away perspective view of a portion of the rear end of the load lifting mechanism showing certain structural features thereof.

In addition to the pivotal connection of boom assembly 32 to trolley 34 at 92, the boom assembly is also connected to the trolley assembly by means of three hydraulic cylinder assemblies, two of which comprise transversely spaced lift cylinders 120 which are pivotally connected at the rod ends by bifurcated brackets 121 to an intermediate transverse brace member 96 and at the base ends to a transverse support shaft 122 which extends between trolley plate 60 and lower boom assembly plate 44 and which is secured at its opposite ends to the inner longitudinal plates 62 of the trolley. The third cylinder 124 is a slave cylinder for a purpose to be described which is pivotally connected at the rod end 126 to the rear transverse brace 96 by a bifurcated bracket and at its base end to the underside of upper trolley plate 60 by a pin and bracket assembly 128. Oval-shaped openings 130 are formed in trolley plate 60 through which extend cylinders 120 and 124, the openings enabling full pivotal action and compact mounting structure for the cylinder assemblies from the limits of pivotal movement thereof as represented by the lowermost pivoted position of boom assembly 32 illustrated in FIG. 4 to the uppermost pivoted position thereof as illustrated in FIGS. 5, 6 and 9. In addition, a second slave cylinder assembly 132 is pivotaly connected at the base end outwardly of one side of the truck and boom assembly 30 to the truck body by a pin and bracket means 134, and at the rod end 136 to the rear portion of the one I-beam 46.

A conventional hydraulic system, not shown except for the above-described cylinder assemblies, includes a supply pump and a first directional control valve connected by conduits to cylinders 116, 124 and 132, and second and third control valves connected to lift cylinders 50 and 120, respectively. The second and third control valves may be independently actuated in either direction to energize either one or both lift cylinders 50 and 120 to independently, either singly or in combination, pivotally raise and lower boom assemblies 30 and 32. The pump and first control valve is connected by first and second sets of conduits to slave cylinders 124 and 132 and to tilt cylinder 116. One conduit set interconnects the three rod ends of the said three cylinder assemblies and the other conduit set interconnects the three base ends of said three cylinders, the conduit sets being suitably connected to the control valve and pump for actuating tilt cylinder 116 in either direction to tilt load carrier assembly 36 about pivoted connections 104, either as selected by the operator or to automatically maintain the fork tines 106 in a substantially level position as a result of the operation and cooperation of slave cylinders 124 and 132 during any combination of operation of lift cylinders 50 and 120, as will be explained.

The slave cylinders are responsive only to relative pivotal movement of either one or both boom assemblies and not to variations in pressure in the hydraulic pressure supply to tilt cylinder 116 inasmuch as the slave cylinders are connected to the respective boom assemblies and are incapable of actuating either boom assembly, being adapted to respond solely to pivotal movements of the respective boom assembly for transferring fluid from the respective slave cylinder to tilt cylinder 116. The slave cylinders are designed, related and mounted in such a manner that during movement of either one or both boom assemblies in a closed hydraulic circuit, i.e., with the first control valve not pressurizing tilt cylinder 116, a volume of fluid is transferred by the respective slave cylinders to the tilt cylinder as determined by the relative pivotal movement of the boom assembly or assemblies so as to maintain the fork tines 106 substantially parallel to the ground, or in any other selected attitude such as in a horizontal position when the truck is traveling up or down a grade.

In the latter example the operator first actuates the tilt cylinder to locate the fork tines in horizontal position with the truck on a non-horizontal surface, whereby subsequent actuation of the boom assemblies maintains that selected fork attitude by the operation of the slave cylinders. Whenever the booms are not being actuated the slave cylinders function simply as conduits in the lines from the control valve to the tilt cylinder. During boom actuation one or both slave cylinders, as the case may be, transfer from the rod end or the base end, depending on the direction of movement of the boom assemblies, that volume of fluid required to actuate the tilt cylinder in such a manner as to maintain the pre-selected attitude of the fork tines.

The basic technique of using slave and tilt cylinders to effect a constant load carrier attitude is not new. For example, a single slave cylinder and tilt cylinder combination operating in a similar manner in respect of a single pivoted boom is disclosed in U.S. Pat. No. 2,990,072, granted June 27, 1961. However, my invention includes a significant improvement of the concept in the application thereof to a double pivoted boom construction utilizing dual slave cylinders cooperating as aforesaid to perform said function.

In operation, the versatility of my invention in substantially exceeding heretofore known combinations of reach, lift and lower of such a mobile load carrier is well illustrated in operational FIGS. 4–9, which show representative intermediate and extreme positions of the load carrier 36 within the range of available operation.

Figure 4:
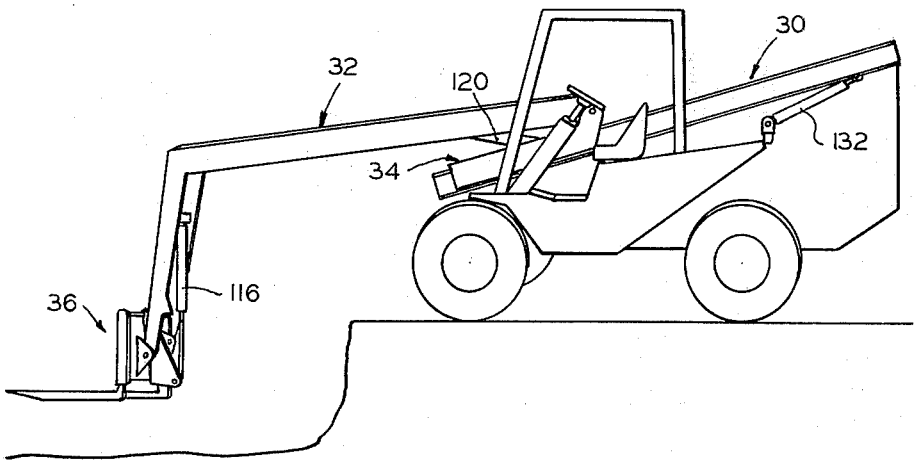
FIGS. 4 through 9 are side elevational views showing the truck and load lifting mechanism in a plurality of exemplary operating positions.
Figure 5:
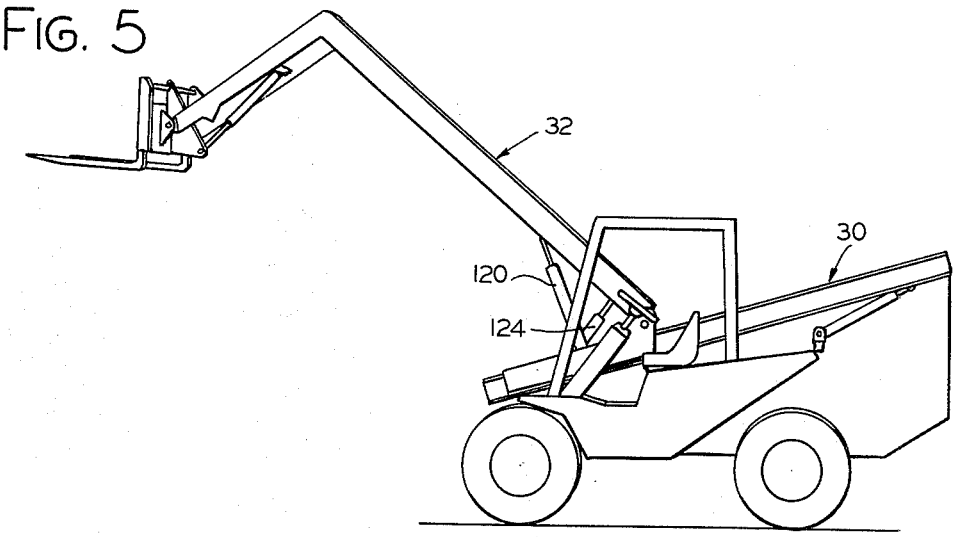
Figure 6:
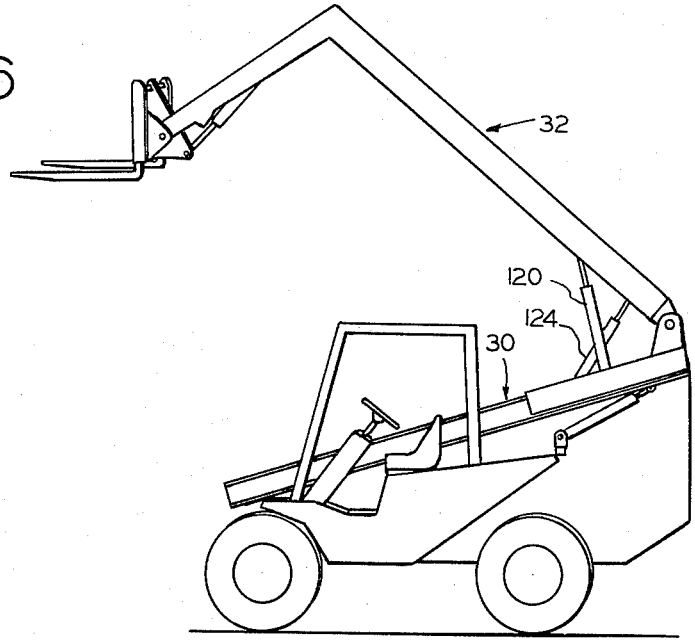
Figure 7:
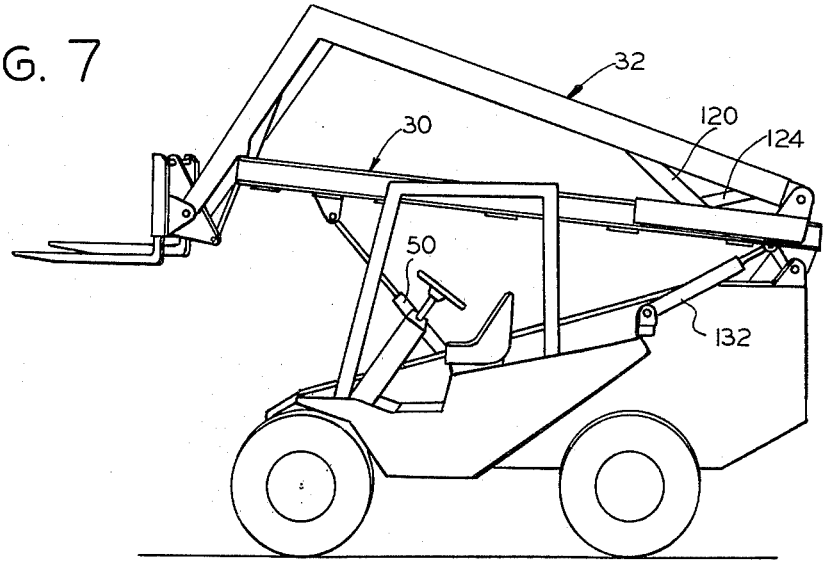
Figure 8:
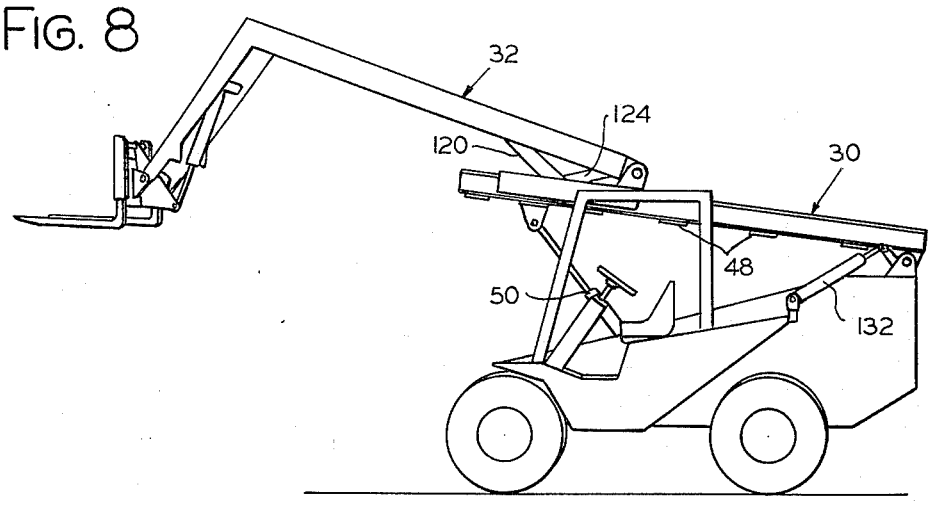

The various exemplary operating conditions illustrated in FIGS. 4–9 are largely self-explanatory, but a brief reference thereto is in order. FIG. 4 shows the furthest reach-out position of carrier 36 in a negative lift position in which trolley 34 has been actuated by the hydraulic motor, sprockets and drive chain best shown in FIG. 10 to a forwardmost position in boom assemblies 30 and 32, both of which are shown actuated to fully lowered positions by full retraction of cylinders 50 and 120. FIG. 5 differs from FIG. 4 only in that boom 32 appears in a fully elevated position, i.e., cylinders 120 are at full extension, whereas FIG. 6 differs from FIG. 5 only in that the trolley and upper boom assemblies have been actuated to a fully retracted position relative to boom 30. FIGS. 7, 8 and 9 illustrate a position of full elevation of boom 30, with boom 32 retracted and lowered in FIG. 7, extended and lowered in FIG. 8, and extended and elevated in FIG. 9. It will be noted that in FIG. 1 boom 30 is fully lowered while boom 32 is elevated a small amount in a retracted position which locates load carrier 36 in a normal load carrying travel position. All intermediate positional combinations of carrier 36 within the total combination of possible movements of boom 30, trolley 34, and boom 32 are, of course, available. Good operator visibility is inherent in my design, as is apparent from the drawing.

In all of FIGS. 1–9 the truck is shown positioned on a horizontal surface with the load carrier 36 positioned so that the fork tines 106 remain substantially horizontal. The initial positioning of the fork tines, such as in the position shown in FIG. 1, is automatically maintained by the operation of slave cylinders 124 and 132 and tilt cylinder 116, throughout all possible manipulations of the boom and trolley assemblies, assuming that the horizontal attitude of the fork tines is not selectively changed by the operator by actuation of tilt cylinder 116 to effect an attitude other than horizontal. If any such other attitude is selected than that attitude will be maintained during all such manipulations of the boom and trolley assemblies. From any first selected position of the boom and trolley assemblies the load carrier 36 can, of course, be actuated to any other selected forward or rearward tilt position by cylinder 116 and then returned to a horizontal position, for example, subsequent to which the fork tines will remain in the last selected position during subsequent manipulation of the boom and trolley assemblies.

Thus, it will be appreciated that substantially more varied and flexible maneuvers than heretofore in elevation, lowering and degree of reach-out forwardly of the truck, combined with full retraction relative to the truck, may be accomplished by my invention in a relatively simple, compact, rugged truck and load handling structure. If desired an upright construction of the type used on standard fork lift trucks, for example, could be mounted pivotably from the end of boom portions 100 in which a fork carrier would be mounted for elevation in the upright, which could also be telescopic, in a well-known manner, the upright being connected to one or more tilt cylinders for control in a manner similar to the control of load carrier 36 as described above. Such a construction would, of course, increase the cost, complexity and bulk of the complete assembly, but would afford a substantially higher available elevation than is shown in FIG. 9, if that were found to be desirable.

It will be understood by those skilled in the art that various modifications may be made in the structure, form, and relative arrangement of parts without necessarily departing from the spirit and scope of the invention. Accordingly, it should be understood that I intend to cover by the appended claims all such modifications which fall within the scope of my invention.

I claim:

1. An extensible reach load lifting mechanism for a truck or similar vehicle comprising first boom means pivotally connected adjacent one end of the truck and extending longitudinally thereof to a position adjacent the opposite end, first means for elevating the boom means above the truck about said pivotal connection, trolley means mounted on said boom means for movement longitudinally thereof and of the truck, means for actuating said trolley means longitudinally of said boom means, second boom means pivotally connected at one end to said trolley means and extending longitudinally of the first boom means and of the truck, second means for elevating said second boom means above the truck and above said first boom means.

2. A load lifting mechanism as claimed in claim 1 wherein said first and second elevating means are operable simultaneously in any actuated position of said trolley means for actuating said first and second boom means simultaneously.

3. A load lifting mechanism as claimed in claim 2 wherein said first and second elevating means are independently controllable to operate said first and second boom means simultaneously in elevation or in lowering movement, or operating said second boom means in elevation while said first boom means is lowered or vice versa.

4. A load lifting mechanism as claimed in claim 1 wherein said first boom means may be actuated up or down by said first elevating means while said second boom means is unactuated by said second elevating means, and vice versa.

5. A load lifting mechanism as claimed in claim 1 wherein first compensating means is operatively connected between the truck and said first boom means, second compensating means is operatively connected between said trolley means and said second boom means, and third compensating means is operatively connected between said second boom means and said load carrier means, said first, second and third compensating means cooperating during actuation of said first and second boom means to maintain said load carrier means in a predetermined attitude.

6. A load lifting mechanism as claimed in claim 5 wherein said first and second compensating means comprise hydraulic slave cylinder means, said first slave cylinder means being pivotally connected to the truck and to said first boom means, and said second slave cylinder means being pivotally connected to the trolley means and to the second boom means.

7. A load lifting mechanism as claimed in claim 6 wherein said third compensating means is a hydraulic cylinder means pivotally connected to the second boom means and to the load carrier means and hydraulically connected to both said first and second compensating means.

8. A load lifting mechanism as claimed in claim 7 wherein said first and second slave cylinder means are hydraulically connected to each other rod-end-to-rod-end and base-end-to-base-end and to said third compensating means.

9. A load lifting mechanism as claimed in claim 8 wherein said third compensating means is independently operable to adjust said load carrier means pivotally on said second boom means in either direction, under which latter condition said first and second slave cylinder means remain in fixed positions during non-actuation of said first and second boom means.

10. A load lifting mechanism as claimed in claim 1 wherein said first elevating means is a hydraulic cylinder means connected pivotally at its one end to the truck and at its opposite end to said first boom means, and said second elevating means is a hydraulic cylinder means connected pivotally at its one end to said trolley means and at its opposite end to said second boom means.

11. A load lifting mechanism as claimed in claim 5 wherein said first elevating means is a hydraulic cylinder means connected pivotally at its one end to the truck and at its opposite end to said first boom means and said second elevating means is a hydraulic cylinder means connected pivotally at its one end to said trolley means and at its opposite end to said second boom means.

12. A load lifting mechanism as claimed in claim 1 wherein endless drive chain means is connected to said trolley means, and motor driven sprocket means is connected to said drive chain at opposite end portions of said first boom means.

13. A load lifting mechanism as claimed in claim 1 wherein said first boom means when actuated to a fully lowered position extends longitudinally downwardly and forwardly of the truck and said second boom means is actuatable to a negative lift position when fully lowered on said downwardly extending first boom means.

14. A load lifting mechanism as claimed in claim 1 wherein first, second and third compensating means are operatively connected between the truck and first boom means, the trolley and second boom means, and the second boom means and load carrier means, respectively, cooperating to maintain automatically in a predetermined attitude said load carrier means irrespective of the sequence of actuating said first and second boom means and trolley means within the design range of compensatory operation of said first, second and third compensating means.

15. A load lifting mechanism as claimed in claim 13 wherein said second boom means includes a downwardly extending forward boom portion, said load carrier means being supported from the end of said forward boom portion.

16. A load lifting mechanism as claimed in claim 1 wherein said second elevating means comprises hydraulic cylinder means having one end pivotally connected to said second boom means and the opposite end pivotally connected to said trolley means.

17. A load lifting mechanism as claimed in claim 16 wherein said first boom means slopes longitudinally downwardly towards said opposite end of the truck, and said trolley means is of generally inverted U-shape mounted in and transversely above said first boom means for longitudinal traverse thereof.

18. A load lifting mechanism as claimed in claim 17 wherein said second elevating means is connected to said trolley means interiorly of the inverted U-shaped pocket thereof.

19. A load lifting mechanism as claimed in claim 1 wherein said first and second elevating means are operable in any actuated position of said trolley means longitudinal of said first boom means selectively and independently one from the other for elevating said first and second boom means selectively and independently one from the other.

* * * * *